United States Patent [19]

Gautier

[11] Patent Number: 4,770,078

[45] Date of Patent: Sep. 13, 1988

[54] ROLL-TYPE CUTTING/SCORING APPARATUS

[76] Inventor: Jean Gautier, 78 rue Ferdinand Buisson, Lyon 3éme (Rhône), France

[21] Appl. No.: 25,383

[22] Filed: Mar. 13, 1987

[30] Foreign Application Priority Data

Mar. 13, 1986 [FR] France ..... 86 04123

[51] Int. Cl.[4] ..... B26D 1/36; B26D 1/42

[52] U.S. Cl. ..... 83/344; 83/346; 83/348; 83/659; 83/663

[58] Field of Search ..... 83/331, 344, 346, 347, 83/348, 659, 663, 665; 403/5, 11, 31

[56] References Cited

U.S. PATENT DOCUMENTS

| | | | |
|---|---|---|---|
| 4,452,116 | 6/1984 | Kesten | 83/659 |
| 4,507,996 | 4/1985 | Kesten | 83/346 |
| 4,553,461 | 11/1985 | Belongia | 83/344 |
| 4,641,558 | 2/1987 | Hoffman | 83/346 |

*Primary Examiner*—E. R. Kazenske
*Assistant Examiner*—Hien H. Phan
*Attorney, Agent, or Firm*—Herbert Dubno; Ronald Lianides; Andrew Wilford

[57] ABSTRACT

An apparatus for scoring or cutting has a generally stationary frame, a lower cradle in the frame, and a plurality of lower rollers rotatable in the cradle about respective roller axes and all tangent to an imaginary lower cylinder centered on a lower axis. A lower arbor centered on the lower axis has one end projecting into and supported by a lower journal in the frame and an opposite unsupported end. A lower tube is fitted snugly on the lower arbor and has an outer surface lying on the lower cylinder and resting on the lower rollers. Similarly, an upper pressure plate in the frame carries a plurality of upper rollers rotatable in the pressure plate about respective axes and all tangent to an imaginary upper cylinder centered on an upper axis. An upper arbor centered on the upper axis has one end projecting into and supported by an upper journal in the frame and an opposite unsupported end. An upper tube fitted snugly on the upper arbor has an outer surface lying on the upper cylinder and resting on the upper rollers, one of the tubes being formed with at least one annular cutting/scoring ridge. The frame is formed at the opposite ends with a window sufficiently large that the tubes can be withdrawn axially from the respective arbors through the window. Actuators braced between the frame and the pressure plate push the upper tube downward.

6 Claims, 3 Drawing Sheets

ROLL-TYPE CUTTING/SCORING APPARATUS

FIELD OF THE INVENTION

The present invention relates to an apparatus for cutting and/or scoring a workpiece. More particularly this invention concerns a roll-type device used for forming a longitudinal cut or score line in a workpiece that is passed through it.

BACKGROUND OF THE INVENTION

Figure 1:
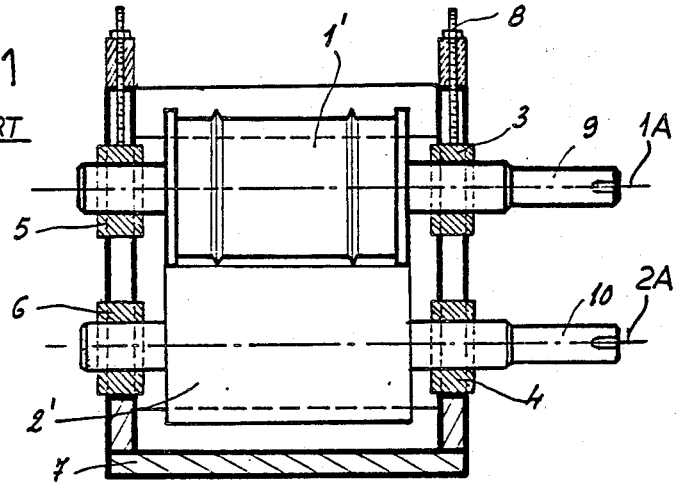
FIG. 1 PRIOR ART
FIG. 1 is a cross sectional view of a prior-art cutting/scoring apparatus.
Figure 2:
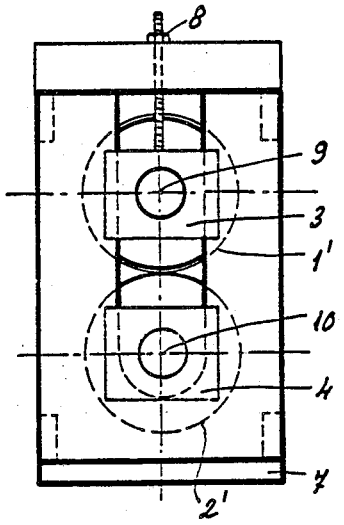
FIG. 2 PRIOR ART
FIG. 2 is an end view of the prior-art apparatus of FIG. 1.
Figure 3:
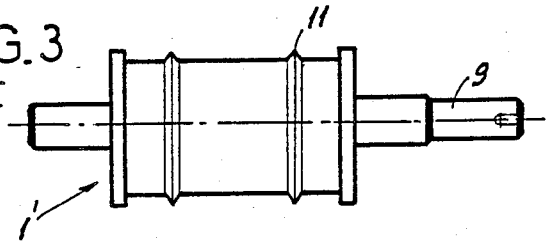
FIG. 3 PRIOR ART
FIG. 3 is a side view of the cutting/scoring roll of the prior-art apparatus.

As seen in FIGS. 1 through 3 a standard prior-art apparatus that serves to form cut or score lines in a workpiece has an upper cutting/scoring roll 1' and a lower anvil or counterroll 2' supported in respective pairs of bearing or journal blocks 3 through 6 in a stationary frame 7 for rotation about respective parallel and horizontal axes 1A and 2A. Screws 8 can bear between the frame 7 and the bearing blocks 3 and 5 of the upper roll 1' to press it down against the lower roll 2'. The rolls 1' and 2' have respective stub shafts 9 and 10 at least the former of which is normally driven, and the upper roll 1' has annular pointed ridges 11 that form the cuts or score lines in a workpiece that is passed between the two rolls 1' and 2' in a direction perpendicular to the plane defined by the axes 1A and 2A. The lower anvil roll 2' is perfectly cylindrical and centered on the respective axis 2A.

A major problem with this type of system is that the pressure that is exerted by the screws 8 is applied via the bearings 3 and 5 and shafts 9. Not only does this represent a substantial radial load for these bearings 3 and 5, but it also has a lever action that can bend the upper roll 1'. When there are more than two cutting/scoring ridges 11, the inner such ridges can move up out of contact with the anvil roll 2' when the upper roll 1' bows as a result of being pushed down at its ends, so that the cut or score lines formed thereby will be too shallow.

Furthermore when it is necessary to change the cutting roll 1', whose ridges 11 wear out much more rapidly than any parts of the anvil roll 2', it is necessary to disassemble the frame 7, pull the bearings 3 and 5, uncouple the drive, and generally keep the machine down for at least a few hours. This down time is extremely expensive in the type of mass production operation such a cutting/scoring device is used in. In addition such repeated disassembling of the equipment invariably introduces play into the mechanism, and when the rolls do not turn about perfectly parallel axes the cutting or scoring is very poor.

The rolls must be made of a very durable metal and are invariably turned to form with their stub shafts a single unitary piece. As a result these rolls are very costly. Their high cost is coupled with a complete inability to temporarily fix or adjust a worn but still usably sharp cutter drum.

A further disadvantage is that the operator of such a machine will inherently compensate for misalignment or poor operation by increasing the pressure exerted by the screws 8. Such increase in pressure not only increases the tendency of the roll 1' to bow, but also increases how much the cutting ridges 11 wear and thereby decreases service life.

OBJECTS OF THE INVENTION

It is therefore an object of the present invention to provide an improved roll-type cutting/scoring apparatus.

Another object is the provision of such a roll-type cutting/scoring apparatus which overcomes the above-given disadvantages, that is whose rolls can be produced cheaply, yet which is easy to adjust and service and which will have a long service life.

SUMMARY OF THE INVENTION

An apparatus for scoring or cutting according to the invention has a generally stationary frame, a lower cradle in the frame, and a plurality of lower rollers rotatable in the cradle about respective axes and all tangent to an imaginary cylinder centered on a lower axis. A lower arbor centered on the lower axis has one end projecting into and supported by a lower journal in the frame and an opposite unsupported end. A lower tube is fitted snugly on the lower arbor and has an outer surface lying on the upper cylinder and resting on the lower rollers. Similarly, an upper pressure plate in the frame carries a plurality of upper rollers rotatable in the pressure plate about respective axes and all tangent to an imaginary cylinder centered on an upper axis. An upper arbor centered on the upper axis has one end projecting into and supported by an upper journal in the frame and an opposite unsupported end. An upper tube fitted snugly on the upper arbor has an outer surface lying on the upper cylinder and resting on the upper rollers, one of the tubes being formed with at least one annular cutting/scoring ridge. The frame is formed at the opposite ends with a window sufficiently large that the tubes can be withdrawn axially from the respective arbors through the window. Actuators braced between the frame and the pressure plate push the upper tube downward. A drive is connected to one of the one ends for rotating the respective arbor and tube.

In accordance with this invention the arbors are expansible for locking the respective tubes thereon. More particularly the arbor of either tube is at least partially hollow and the apparatus has a pump or blower for radially expanding the respective arbor to compensate for wear. When this arbor is formed with a plurality of axially spaced chambers they can be independently pressurizable by the expanding means for locally compensating for wear. Thus when, for instance, one of the cutting/scoring ridges wears down more than the others or a complementary groove forms in the counterroll, it is possible to expand the tube at this location by pressurizing an annular chamber in the arbor directly under the ridge in question. Such a procedure allows one to stretch the normal service life of such a device considerably.

For best control and good monitoring of the apparatus of this invention pressure sensors are engaged between the plate and the frame for detecting the pressure exerted by the actuator on the plate. In addition the rollers are horizontally paired and each pair is provided with a hydraulic suspension.

SPECIFIC DESCRIPTION

Figure 4:
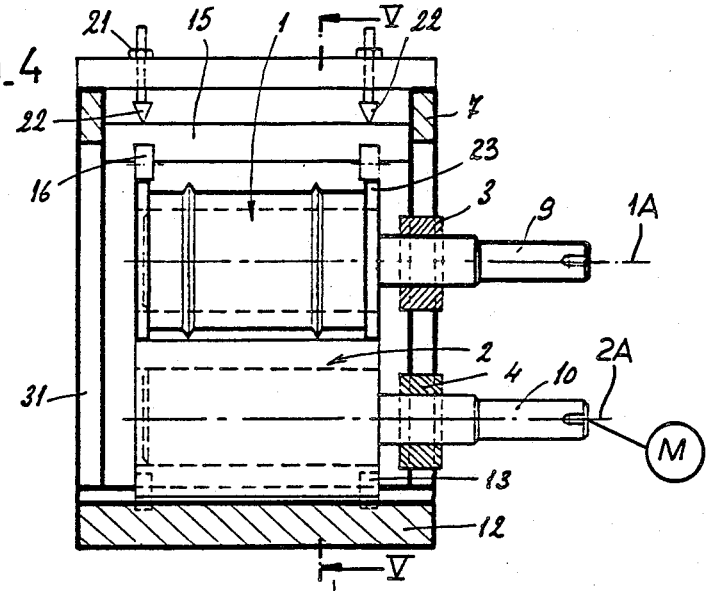
FIG. 4 is a cross sectional view of a cutting/scoring apparatus according to the instant invention.
Figure 5:
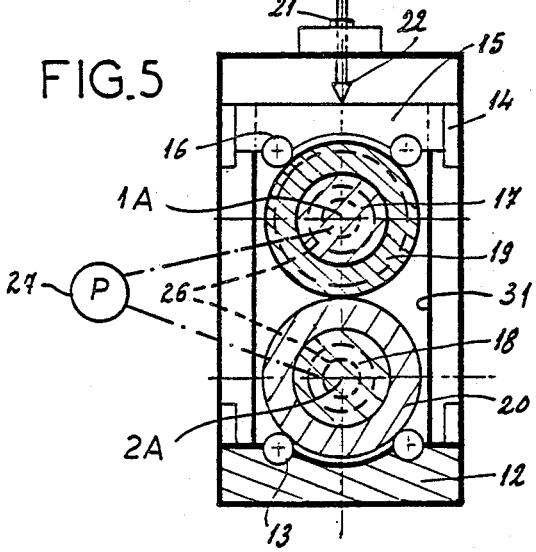
FIG. 5 is a section taken along line V—V of FIG. 4.
Figure 6:
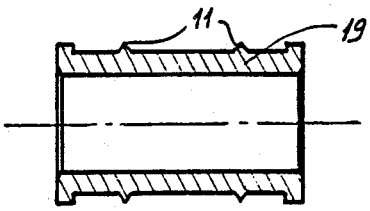
FIG. 6 is an axial section through the outer tube of the upper cutting/scoring roll of the apparatus of FIG. 4.

As seen in FIGS. 4 through 6, where the reference numerals of FIGS. 1 through 3 have been used for functionally identical structure, the primary difference between the prior-art cutting/scoring apparatus and that of the instant invention is that the upper and lower rolls 1 and 2 are each formed of two parts, namely an arbor 17 or 18 and an outer sleeve 19 or 20. In addition the arbors 17 and 18 only extend as stub shafts 9 and 10 on one end of the respective rolls 1 and 2. At the drive side (to the right in FIG. 4) the frame 7 supports the shafts 9 and 10 in bearings 3 and 4, but on the service side (to the left in FIG. 4) it is formed with a window 31 sufficiently large that the tubes 19 and 20 can be withdrawn axially through the frame 7.

The lower roll 2 sits in a cradle 12 forming part of the frame 7 and itself carrying four lower rollers 13 rotatable about two lower axes parallel to the axes 1A and 2A. These rollers 13 have outer peripheries lying on the outer cylindrical surface of the tube 20 of the lower roll 2 at the opposite axial ends thereof. Thus the bearing 4 can float somewhat so that all the downward force exerted on or by the lower roll 2 is transferred by these rolls 13 directly to the sole plate or cradle 12 of the frame 7. Such construction not only greatly reduces the wear on the bearing 4 which primarily will be resisting horizontal forces perpendicular to the plane of the axes 1A and 2A, but also allows the bearing 6 of the prior-art system to be completely eliminated.

Similarly the upper roll 1 can be pressed downward by four upper rollers 16 carried on an upper pressure plate 15 itself pressed downward by actuators 21 similar to the actuators 8. Each such upper roller 16 is directly above a respective one of the lower rollers 13, but engages a square-section rim 23 at the respective end of the upper-roll tube 19. The upper-roll bearing 3 can float like the bearing 4, and once again there is no structure comparable to the bearing 5 of FIG. 1.

Figure 7:
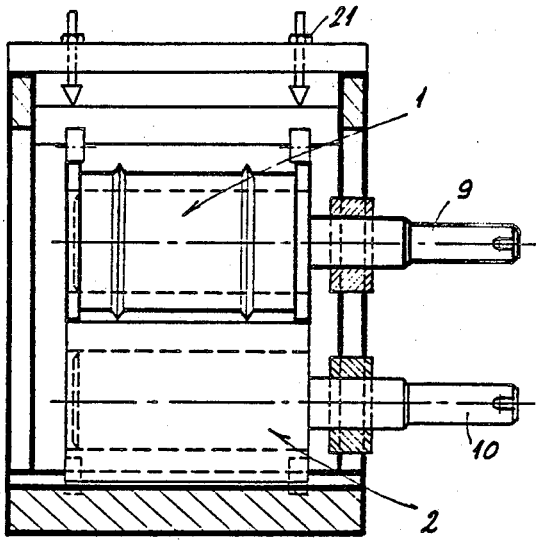
FIGS. 7 and 8 are views similar to FIGS. 4 and 5, respectively, showing another embodiment of the cutting/scoring apparatus according to this invention.
Figure 8:
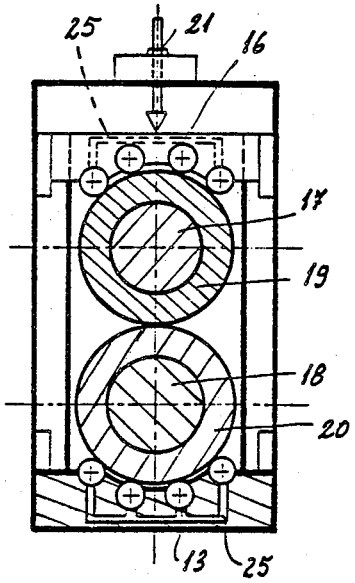

In FIGS. 7 and 8 there are four lower rolls 13 and four upper rolls 16 at each end of the respective rolls 2 and 1, with the rolls of each set of four angularly equispaced. In addition the rolls are supported in hydraulically loaded cushions that are interconnected as shown at 25 so they automatically adjust and center on the respective axes 1A or 2A.

In addition the actuators 21 of this invention act through strain gauges 22 so that an extremely accurate reading of the pressure being applied is possible.

According to this invention the arbors 17 and 18 are formed with chambers 26 spaced along their length and individually pressurizable by a pump 27. The outer diameter of each arbor 17 or 18 is just slightly smaller than the inside diameter of the respective sleeve 19 or 20 so that the same can be easily slipped axially thereover. When, however, the chambers 26 are pressurized the arbors 17 and 18 swell slightly, thereby entering in all-around surface contact with the inside surfaces of the respective sleeves 19 and 20. Not only does this make for a very good torque-transmitting connection, but it also allows one or the other of the arbors 17 or 18 to be swelled locally to compensate for local wear. Thus if, for instance, one of the ridges 11 wears excessively the corresponding chambers 26 of the upper and lower rolls 1 and 2 can both be overpressurized a little to compensate for such wear.

As a result it is possible to change nothing but the sleeves or tubes 19 and 20 when the respective rolls 1 and 2 are worn. This can be done simply by withdrawing them through the window 31. No disassembly of the frame 1 is necessary, nor any disconnection of transmissions and the like from the shafts 9 and 10.

More particularly the rolls 1 and 2 are refitted as follows:

1. The actuators 21 are shortened somewhat, pressure in the chambers 26 is relieved, and then the sleeves 19 and 20 are pulled off the respective arbors 17 and 18, leaving same projecting cantilevered from the respective drive-side bearings 3 and 4.

2. New sleeves 19 and 20 are slid through the window 31 onto the arbors 17 and 18 which are then swelled up to lock them in place, and pressure is reapplied by the actuators 21. Such an operation can literally be completed in 2 min to 10 min, as compared to the hours that are necessary to refit the prior-art machine of FIGS. 1 through 3.

The use of several rollers to support and guide each roll 1 and 2 means that they will be perfectly centered, while the bearings 3 and 4 can be expected to have an extremely long service life. Wear-and-tear on the drive side transmission and motors is reduced by not subjecting this equipment to frequent disassembly. Furthermore the tubes 19 and 20 can be produced much more economically than the solid rolls of the prior art. The lower first cost plus the increased service life of the rolls of the system of this invention brings the overall cost of the apparatus of this invention very low.

I claim:

1. An apparatus for scoring or cutting, the apparatus comprising:

a generally stationary frame;

a lower cradle in the frame;

a plurality of lower rollers rotatable in the cradle about respective axes and all tangent to a lower imaginary cylinder centered on a lower axis;

a lower arbor centered on the lower axis and having one end projecting into the frame and an opposite unsupported end;

a lower journal supporting the one end in the frame;

a lower tube fitted snugly on and slidably removable from the lower arbor and having an outer surface lying on the lower imaginary cylinder and resting on the lower rollers;

an upper pressure plate in the frame;

a plurality of upper rollers rotatable in the pressure plate about respective axes and all tangent to an upper imaginary cylinder centered on an upper axis;

an upper arbor centered on the upper axis and having one end projecting into the frame and an opposite unsupported end;

an upper journal supporting the one end of the upper arbor in the frame;

an upper tube fitted snugly on and slidably removable from the upper arbor and having an outer surface lying on the upper imaginary cylinder and resting on the upper rollers, one of the tubes comprises at least one annular cutting and scoring ridge, the frame comprises an opening defining a window located on a side of the frame facing the unsupported ends of the arbors, the window being larger than the diameter of the tubes to allow withdrawal of tubes axially from the respective arbors;

means including at least one actuator braced between the frame and the pressure plate for pushing the upper tube downward; and means connnected to one of the one ends for rotating the respective arbor and tube.

2. The apparatus for scoring or cutting defined in claim 1 wherein the arbors are expansible for locking the respective tubes thereon.

3. The apparatus for scoring or cutting defined in claim 1, further comprising pressure sensors engaged between the plate and the frame for detecting the pressure exerted by the actuator on the plate.

4. The apparatus for scoring or cutting defined in claim 1 wherein the arbor of the other one of the tubes is at least partially hollow, the apparatus further comprising means for radially expanding the other one of the tubes arbor to compensate for wear.

5. The apparatus for scoring or cutting defined in claim 1 wherein the other one of the tubes arbor is formed with a plurality of axially spaced chambers independently pressurizable by the expanding means for locally compensating for wear.

6. The apparatus for scoring or cutting defined in claim 1 wherein the rollers are horizontally paired and each pair is provided with a hydraulic suspension.

* * * * *